US007367379B2

(12) United States Patent
Heine

(10) Patent No.: US 7,367,379 B2
(45) Date of Patent: May 6, 2008

(54) ARRANGEMENT FOR SECURING A HEAT EXCHANGER TO ANOTHER HEAT EXCHANGER

(75) Inventor: Reinhard Heine, Remseck (DE)

(73) Assignee: BEHR GmbH & Co. KG, Stuttgart (DE)

( * ) Notice: Subject to any disclaimer, the term of this patent is extended or adjusted under 35 U.S.C. 154(b) by 0 days.

(21) Appl. No.: 10/575,903

(22) PCT Filed: Sep. 13, 2004

(86) PCT No.: PCT/EP2004/010193

§ 371 (c)(1),
(2), (4) Date: Aug. 15, 2006

(87) PCT Pub. No.: WO2005/038374

PCT Pub. Date: Apr. 28, 2005

(65) Prior Publication Data

US 2007/0089855 A1 Apr. 26, 2007

(30) Foreign Application Priority Data

Oct. 16, 2003 (DE) ..... 103 48 701

(51) Int. Cl.
*F28F 9/007* (2006.01)

(52) U.S. Cl. ..... 165/67; 165/140; 180/68.4

(58) Field of Classification Search ..... 165/67, 165/140; 180/68.4
See application file for complete search history.

(56) References Cited

U.S. PATENT DOCUMENTS 4,997,033 A * 3/1991 Ghiani et al. ..... 165/67
5,139,080 A 8/1992 Bolton et al.
5,537,839 A 7/1996 Burk et al.
5,657,817 A * 8/1997 Heine et al. ..... 165/67
5,996,684 A * 12/1999 Clifton et al. ..... 165/67
6,012,512 A 1/2000 Ghiani
6,038,884 A 3/2000 Dabrowski
6,158,500 A * 12/2000 Heine ..... 165/67
6,202,737 B1 * 3/2001 Mahe ..... 165/67
6,273,182 B1 * 8/2001 Pautler et al. ..... 165/67
6,354,368 B1 3/2002 Nishishita et al.
6,527,044 B2 3/2003 Mangold
6,607,025 B2 * 8/2003 Gille ..... 165/140
6,615,604 B2 * 9/2003 Neufang ..... 62/298

(Continued)

FOREIGN PATENT DOCUMENTS

DE 42 38 853 A1 5/1994

(Continued)

*Primary Examiner*—Allen J. Flanigan
(74) *Attorney, Agent, or Firm*—Foley & Lardner LLP

(57) ABSTRACT

The invention relates to an arrangement which is used to secure a first heat exchanger to a second heat exchanger. The first heat exchanger (11) is arranged parallel to the second heat exchanger (1) and comprises a heat exchanger block (12) in addition to collector pipes arranged on both sides thereof, and which more particularly comprise an integrated collector (14). The second heat exchanger comprises a pipe/rib block provided with collector boxes (4) which are secured on both sides thereon and which are made of a casting or injection type material, especially plastic. The invention also relates to a first heat exchanger (11) which is secured by means of retaining means (16, 18) which are injected onto the collector boxes (4) of the second heat exchanger.

9 Claims, 2 Drawing Sheets

U.S. PATENT DOCUMENTS

Figure 1:
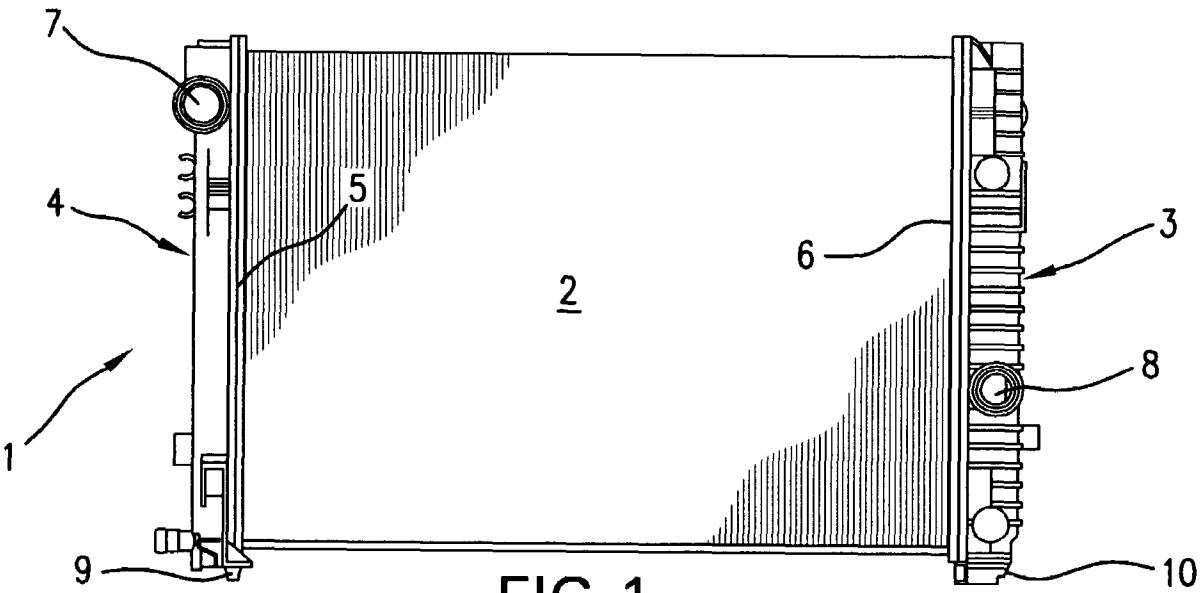

| | | | | |
|---|---|---|---|---|
| 6,827,129 | B2 * | 12/2004 | Ozawa et al. | 165/67 |
| 7,036,561 | B2 * | 5/2006 | Yagi et al. | 165/67 |
| 2001/0013405 | A1 * | 8/2001 | Mangold | 165/67 |
| 2002/0157812 | A1 * | 10/2002 | Anderson et al. | 165/67 |

FOREIGN PATENT DOCUMENTS

| | | | |
|---|---|---|---|
| DE | 196 45 502 | A1 | 5/1997 |
| DE | 297 07 571 | U1 | 8/1997 |
| DE | 198 14 028 | A1 | 10/1998 |
| DE | 197 22 097 | A1 | 12/1998 |
| DE | 695 07 070 | T2 | 6/1999 |
| DE | 198 57 494 | A1 | 7/1999 |
| DE | 198 25 561 | A1 | 12/1999 |
| DE | 100 02 745 | A1 | 7/2001 |
| DE | 101 27 780 | A1 | 12/2002 |
| DE | 101 38 247 | A1 | 2/2003 |
| DE | 698 14 904 | T2 | 1/2004 |
| EP | 0 915 308 | A1 | 5/1999 |
| FR | 2779221 | A1 * | 12/1999 |
| FR | 2 822 941 | A1 | 10/2002 |
| JP | 10016543 | A * | 1/1998 |

* cited by examiner

ARRANGEMENT FOR SECURING A HEAT EXCHANGER TO ANOTHER HEAT EXCHANGER

The invention relates to an arrangement for fastening a first heat exchanger to a second heat exchanger according to the preamble of patent claim 1.

Fastening heat exchangers to one another is known in particular in so-called cooling modules or front ends of motor vehicles. A cooling module, which is arranged in the front engine space of the motor vehicle, conventionally comprises a coolant radiator, a charge air cooler and/or a condenser, which are fastened to one another and thus form a modular unit. The heat exchangers are sometimes also fastened separately in the vehicle, as is known from EP-A 915 308 for a refrigerant condenser of a motor vehicle air conditioning unit. The refrigerant condenser comprises a soldered tube/fin block having tube ends which open out into collecting tubes arranged at both sides and are also soldered to said collecting tubes. The refrigerant flows in and out via so-called block connections which are soldered to the collecting tubes. Four holding elements are arranged on the tube/fin block in order to fasten the condenser, which holding elements fasten the entire condenser in the vehicle, usually in front of a coolant radiator. In addition to the collecting tubes, the known condenser has a collecting container which is known as an integrated collecting container from DE-A 42 38 853 of the applicant. Here, the collecting container or collector is connected directly to one of the collecting tubes.

Another condenser fastening is known from DE-A 196 45 502, specifically also for a soldered condenser having a tube/fin block comprising flat tubes and cooling fins. In order to fasten the known condenser in the vehicle, holding elements in the form of metal plates with fastening lugs are screwed on or riveted on to both sides of the tube/fin block. A disadvantage of the known condenser fastenings is that they require additional holding means which are connected to the tube/fin block by means of screws, rivets or clamps.

It is also known for fastening elements to be soldered on to the collecting tubes so that the condenser can be fastened in the vehicle or to an adjacent heat exchanger, for example a coolant radiator which serves to cool a liquid coolant for the internal combustion engine of the motor vehicle. Coolant radiators are constructed differently than refrigerant condensers and often have a soldered network with soldered tube plate and a coolant tank which is produced as a plastic injection-molded part and thus offers the opportunity to integrally injection-mold coolant pipe stubs and fastening elements onto the coolant tank. This is known for the fastening of fan cowlings or charge-air coolers. Here, corresponding fastening elements which are connected to or engage in associated fastening elements on the coolant tank are integrally injection-molded either onto the fan cowling or onto the air tanks, which are likewise produced from plastic, of the charge air coolers. Since a condenser has no plastic tanks, but rather metallic collecting tubes, it is not possible here for fastening elements to be integrally injection-molded on.

It is an object of the present invention to produce a fastening for two heat exchangers of the type mentioned in the introduction which requires as few additional parts as possible for fastening, can be produced as cheaply as possible and can be assembled in a simple manner.

This object is achieved by means of the features of patent claim 1. According to the invention, it is provided that holding means are attached, in particular integrally cast or integrally injection-molded, to the collecting tanks of the second heat exchanger, which holding means fasten the first heat exchanger to the second heat exchanger. This brings about the advantage that additional fastening means, which are screwed, riveted or soldered onto the first heat exchanger, can be dispensed with. This simplifies the construction of the first heat exchanger and reduces production costs. In addition, assembly is simplified because screw connections and the like are no longer necessary.

According to one advantageous embodiment of the invention, the first heat exchanger is held at four corner regions, and the integrally injection-molded holding means on the second heat exchanger are matched to the shape of the first heat exchanger to give a positive and/or non-positive connection. This is advantageously achieved by means of integrally injection-molded hooks in the upper region of the collecting tanks of the second heat exchanger. This design allows the first heat exchanger to be pushed into the hooks, which are arranged at the top, from below.

In a further advantageous embodiment of the invention, the lower fastening elements are formed on the second heat exchanger as a fin-shaped step with snap-action hooks, likewise integrally injection-molded onto one of the collecting tanks. On the one hand, this gives secure support of the first heat exchanger (fixing in the vertical direction), and secondly, gives fixing in the horizontal direction by means of the snap-action hook.

In a further advantageous embodiment of the invention, a so-called block connection is fastened to the first heat exchanger, that is to say to its collecting tubes, which block connection serves as an anchoring element of the first heat exchanger to the second heat exchanger. The block connection is enclosed by an integrally injection-molded hook and is held by a snap-action hook. As a result, the first heat exchanger is adequately fastened to the second heat exchanger without any additional parts. Another advantage is simple assembly by correspondingly pushing the first heat exchanger into the upper hooks from below and subsequently rotating it towards the second heat exchanger until the two lower snap-action hooks engage and thus lock the first heat exchanger in the horizontal direction.

According to a further advantageous embodiment of the invention, the first heat exchanger is embodied as a condenser of a motor vehicle and the second heat exchanger is embodied as a coolant radiator of a motor vehicle, and these are advantageously combined in a cooling module. Here, the coolant radiator is advantageously the module carrier, that is to say, the other components are fastened to it. The condenser, which is composed of aluminum and is soldered entirely in a soldering furnace, can thus be of simple design and be produced cheaply as a result of soldered-on holding means being dispensed with. The additional outlay for the fastening means on the coolant tanks of the radiator is relatively low and is reflected as a one-off cost for the plastic injection mold for the collecting tanks.

Figure 1A:
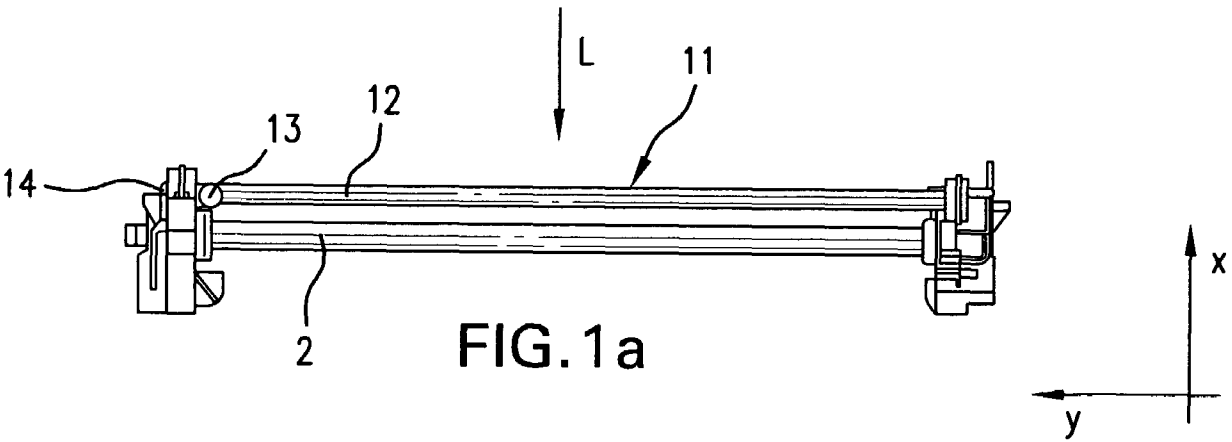
Figure 3A:
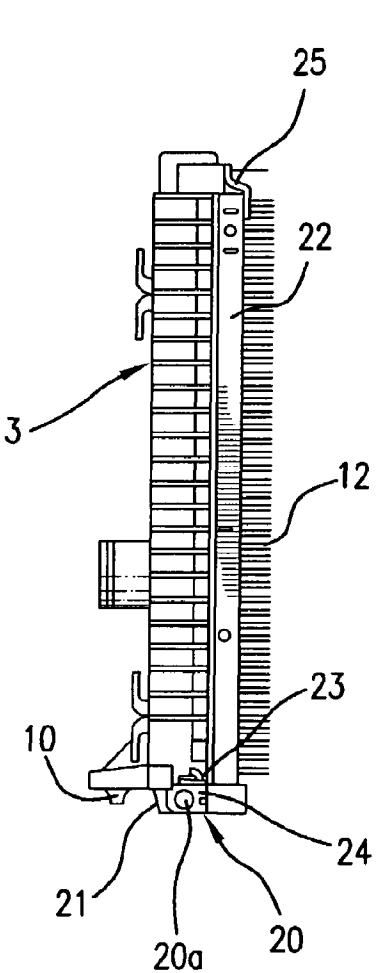
Figure 3:
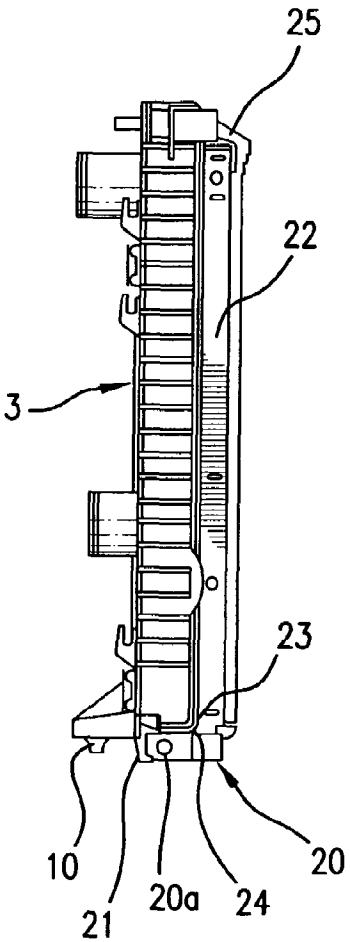
Figure 2A:
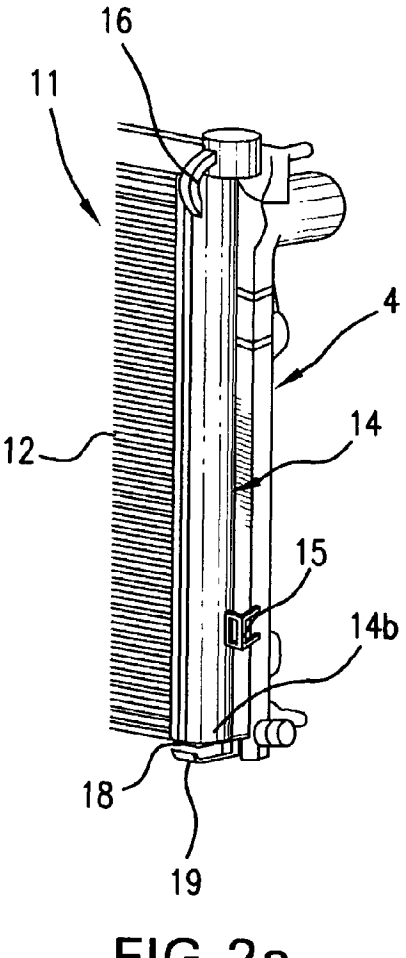
Figure 2:
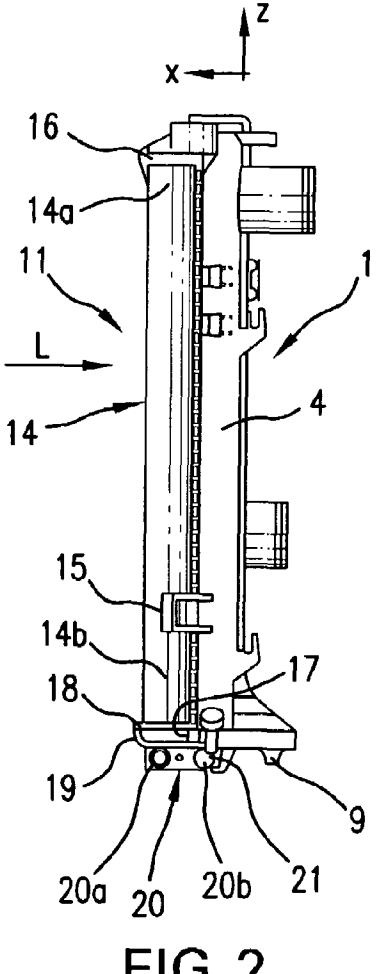

An exemplary embodiment of the invention is described in more detail in the following and is illustrated in the drawing, in which:

FIG. 1 shows a view of a coolant radiator for a motor vehicle with the condenser hidden, FIG. 1*a* shows a view of the coolant radiator and condenser from FIG. 1 from above, FIG. 2 shows a side view from the left of the radiator with the condenser from FIG. 1, FIG. 2*a* shows a 3-D illustration of the side view from FIG. 2, FIG. 3 shows a side view from the right of the radiator with the condenser from FIG. 1, FIG. 3*a* shows a 3-D illustration of the side view from FIG. 3.

FIG. 1 shows a coolant radiator of a motor vehicle in the direction of travel of the motor vehicle, that is to say in the X-direction. The radiator 1 has a preferably soldered radiator block 2 comprising flat tubes and corrugated fins (not illustrated), and has coolant tanks 3, 4 which are arranged on both sides of the block 2 and are produced as plastic injection-molded parts. The two coolant tanks 3, 4 are placed on metallic tube plates 5, 6 and are mechanically connected to the latter. The tube plates 5, 6 are soldered to the block 2, that is to say, tube ends (not illustrated) are held in and soldered into the two tube plates 5, 6. The radiator 1 is embodied as a cross flow radiator, that is to say is installed in the vehicle with vertically positioned coolant tanks 3, 4 and tube plates 5, 6. The coolant flows into the left-hand coolant tank 4 through a coolant inlet pipe stub 7 and flows out via the coolant outlet pipe stub 8 in the right-hand coolant tank 3. Each coolant tank 3, 4 has in its lower region in each case one fastening pin 9, 10, which fastening pins 9, 10 support and fix the radiator 1 relative to the vehicle. The radiator is also fastened in the vehicle at two upper points (not illustrated).

FIG. 1*a* shows the radiator from FIG. 1 in a view from above, the direction of travel X and the transverse direction Y being plotted as coordinates at the right-hand side. The airflow direction is indicated by means of an arrow L. A refrigerant condenser 11 is arranged in front of the radiator 2 in the airflow direction and is—in a way to be explained below—connected to the radiator 2. The condenser 11 has a condenser block 12, which is soldered from flat tubes and corrugated fins (not illustrated), and has at the sides two collecting tubes, of which only the left-hand collecting tube 13, which is integrated with a collector 14, can be seen here. Condensers of this type having an integrated collector are known from the prior art cited in the introduction, that is to say DE-A 42 38 853.

FIG. 2 shows a side view of the radiator 1 from the left with a condenser 11, of which substantially only the collector 14 can be seen, connected in front in the airflow direction. The holding pin 9 is arranged, offset slightly to the right in the airflow direction, on the coolant tank 4. The collecting tank 14 bears against the coolant tank 4 in an approximately parallel manner and is fixed in the Y-direction (perpendicular to the drawing plane) by means of a clip-shaped fin 15 integrally injection-molded on the coolant tank 4. A downwardly pointing hook 16 is integrally injection-molded at the upper end of the coolant tank 4, which hook 16 engages over the upper part 14*a* of the collector 14, fixes it in the X-direction and permits tolerance compensation in the Z-direction. In its lower region, the coolant tank 4 has an integrally injection-molded fin-shaped step 17 which is adjoined in the X-direction by a snap-action hook 18. The lower part 14*b* of the collector 14 rests on the step 17, is therefore fixed in the Z-direction and is held in the X-direction by means of the snap-action hook 18. A bending-resistant fin 19 for protecting the snap-action hook 18 from excessive bending is arranged below the snap-action hook 18. A block connection 20 having two connecting bores 20*a*, 20*b* can be seen below the fin 19, which block connection 20 is connected to the collecting tube which is arranged on that side of the condenser block which faces away from the collector 14. The block connection 20 is enclosed by a hook 21 which is integrally injection-molded onto the coolant tank 4 and fixes the condenser in the Z-direction.

FIG. 2*a* shows the side view from FIG. 2 rotated slightly about a vertical axis (parallel to the Z-axis), that is to say in a 3-D illustration, identical reference signs being used for identical parts. The upper part of the condenser block 12 and the collector 14 can be seen, the upper part 14*a* of which collector 14 is engaged over by the hook 16. The lower part 14*b* of the collector 14 is secured in the forward direction by means of the snap-action hook 18 and is protected from excessive bending by means of the lower fin 19.

FIG. 3 shows the coolant radiator 1 from FIG. 1 in a side view from the right, that is to say looking at the right-hand coolant tank 3, parallel to which is arranged a second collecting tube 22. As already mentioned, the block connection 20 is fastened, that is to say soldered, to the lower end of the collecting tube 22. Refrigerant connections of this type are known from the prior art cited in the introduction; they are provided for connecting a refrigerant inlet line and a refrigerant outlet line (not illustrated). In contrast to the prior art, the block connection 20 is arranged at the end, that is to say at an end face of the collecting tube 22, and thus forms an anchor, by means of which the condenser 11 can be fixed to the radiator 1 or its coolant tank 3. In addition, and as already mentioned, the hook 21 is integrally injection-molded onto the coolant tank 3 at one side, and a snap-action hook 23 is provided at the other side, above the block connection 20 in the Z-direction (likewise integrally injection-molded onto the coolant tank 3), which snap-action hook 23 engages in a corresponding depression 24 in the block connection 20 and thus secures the condenser in the X-direction. The opposite side of the collecting tube 22 from the block connection 20 is engaged over by a hook 25 which is integrally injection-molded onto the coolant tank 3, which hook 25 holds the collecting tube 22 and thus the condenser 11 in the X-direction.

FIG. 3*a* shows the side view from FIG. 3 pivoted slightly about a vertical axis (parallel to the Z-axis), so that the upper part of the condenser block 12 can be seen. In addition, the upper hook 24 and the lower fastening means such as the hook 21 and the snap-action hook 23 can clearly be seen. Finally, the fastening pin 10, which is formed in one piece with the coolant tank 3, is also illustrated.

The two heat exchangers are assembled in the following way: firstly, the condenser 11 is connected to the coolant radiator 1 in that the condenser 11 is slightly tilted (about a horizontal axis), and its upper edge is pushed under the two upper hooks 16 and 24. The condenser 11 is then rotated towards the coolant radiator 1, so that the lower edge of the condenser 11 comes to rest both on the fin-shaped step 17 and the snap-action hook 18, and also between the hook 21 and the snap-action hook 22. Once the two snap-action hooks 18 and 22 have engaged, the assembly process is complete. In order to ensure that the condenser 11 or collector 14 and the coolant tank 4 are in contact without play, bearing fins (not illustrated in more detail) are arranged on the latter, specifically in the region of the upper third of the coolant tank 4.

The invention claimed is:

1. An arrangement for fastening a first heat exchanger to a second heat exchanger, the first heat exchanger being arranged parallel to the second heat exchanger and having a heat exchanger block, four comer regions, and collecting tubes, arranged at both sides, and the second heat exchanger having a tube/fin block with collecting tanks made from a material which can be cast or injection-molded, fastened at both sides, wherein the first heat exchanger is fastened by holding means which are formed integrally with the collecting tanks of the second heat exchanger, and are connected in a positive and/or non-positive manner to the corner regions, wherein a second lower holding means is formed as a rigid hook and as a snap-action hook, wherein a block connection is fastened to the collecting tube at the end side, and wherein the hook and the snap-action hook enclose and secure the block connection.

2. The arrangement as claimed in claim 1, wherein the collecting tanks and the collecting tubes, or the collector, are arranged perpendicularly and parallel to one another, and in that the upper holding means are formed as downwardly-pointing hooks which engage over the collecting tubes, or the collector.

3. The arrangement as claimed in claim 1, wherein a first lower holding means is formed as a fin-shaped step with a snap-action hook, in that the collecting tube, or the collector rests on the step and is secured by means of the snap-action hook.

4. The arrangement as claimed in claim 1, wherein the block connection has a depression in which the snap-action hook engages in a securing manner.

5. The arrangement as claimed in claim 3, wherein a rigid fin for securing the snap-action hook is arranged below the snap-action hook.

6. The arrangement as claimed in claim 1, wherein a clip-shaped fin for fixing the first heat exchanger in the horizontal direction is integrally injection-molded onto a collecting tank.

7. The arrangement as claimed in claim 1, wherein the first heat exchanger is embodied as a condenser of a motor vehicle air conditioning system, and the second heat exchanger is embodied as a coolant radiator for an internal combustion engine of a motor vehicle.

8. The arrangement as claimed in claim 7, the condenser and the coolant radiator are components of a cooling module of a motor vehicle.

9. The arrangement as claimed in claim 7 wherein the condenser is fastened exclusively by the holding means of the coolant radiator.

* * * * *